US005579787A

United States Patent [19]

Wood

[11] Patent Number: 5,579,787

[45] Date of Patent: Dec. 3, 1996

[54] CONTAINER CLEANING APPARATUS AND METHOD

[75] Inventor: Robert B. Wood, Granville, Ohio

[73] Assignee: MPW Industrial Services, Inc., Hebron, Ohio

[21] Appl. No.: 375,539

[22] Filed: Jan. 19, 1995

[51] Int. Cl.[6] ..... B08B 3/02

[52] U.S. Cl. ..... 134/22.1; 134/167 R; 134/181; 134/172; 239/246

[58] Field of Search ..... 134/167 R, 172, 134/181, 198, 177, 180, 168 R, 169 R, 174, 175, 22.1; 239/237, 243, 246, 225.1

[56] References Cited

U.S. PATENT DOCUMENTS

| | | | |
|---|---|---|---|
| Re. 31,495 | 1/1984 | Zublin . | |
| 1,624,865 | 4/1927 | Freel . | |
| 1,693,885 | 12/1928 | Butterworth . | |
| 2,933,093 | 4/1960 | Handyside . | |
| 3,117,584 | 1/1964 | Elenbaas . | |
| 3,399,713 | 6/1968 | Pittman | 134/167 R |
| 3,416,732 | 12/1968 | Reiter . | |
| 3,444,869 | 5/1969 | Guignon et al. . | |
| 3,645,452 | 2/1972 | Stoeckel et al. . | |
| 3,696,825 | 10/1972 | Guignon et al. | 134/181 |
| 3,741,808 | 6/1973 | Stalker | 134/167 R |
| 3,985,572 | 10/1976 | Petermann et al. . | |
| 4,160,457 | 7/1979 | Dickson, Jr. et al. . | |
| 4,220,170 | 9/1980 | Hebert et al. | 134/167 R |
| 4,244,523 | 1/1981 | Looper | 134/167 R |
| 4,603,661 | 8/1986 | Nelson et al. . | |
| 4,646,768 | 3/1987 | Tanaka et al. | 134/167 R |
| 4,715,538 | 12/1987 | Lingnau . | |
| 4,941,491 | 7/1990 | Goerss et al. | 134/111 |
| 5,106,428 | 4/1992 | Goerss et al. . | |
| 5,107,873 | 4/1992 | Clinger . | |
| 5,137,043 | 8/1992 | Wickham, III . | |
| 5,141,165 | 8/1992 | Sharpless et al. . | |
| 5,301,702 | 4/1994 | McKinney | 134/167 R |
| 5,320,072 | 6/1994 | Theiss et al. | 134/167 R |

*Primary Examiner*—Frankie L. Stinson
*Attorney, Agent, or Firm*—Wood, Herron & Evans

[57] ABSTRACT

Apparatus for cleaning a container having a top, an opening in the top, bottom, sides and a longitudinal axis comprises a sprayhead for spraying cleaning solution inside the container and being translatably moveable along the container longitudinal axis and rotatably moveable about the container longitudinal axis. The sprayhead has a pair of spray nozzle orifices opposing and crossing one another and being aimed downwardly into the container. Respective solution streams exiting the pair of nozzle orifices cross and clean the bottom of the container completely to its center. An alternative form of cleaning apparatus for cleaning a container having a fixed agitator comprises a sprayhead for spraying cleaning solution having a pair of nozzle orifices oppositely directed to one another and being aimed toward the sides of the container and defining an axis offset from the sprayhead longitudinal axis. Respective solution streams exiting the pair of nozzle orifices clean the side of the container behind the fixed agitator.

27 Claims, 3 Drawing Sheets

10
44
46
40
36
2
3
3
81
82
52
70
70
34
70
78
78
74
72
72
80
80
76
76
32
40
38
42
14
16
30
12
18
18
22
20
2
94
96
98
92
90

CONTAINER CLEANING APPARATUS AND METHOD

FIELD OF THE INVENTION

This invention relates generally to cleaning apparatus, and more particular to container cleaning apparatus for cleaning portable containers often referred to as to containers, used in the paint industry to transport bulk paint from the paint manufacturer to end users such as automotive plants, etc.

BACKGROUND OF THE INVENTION

Portable containers of up to 650 gallon capacity are used in the paint industry to transport bulk paint from the paint manufacturer to end users such as automotive plants, etc. A major problem in this industry is the cleaning of these portable containers, which must be done thoroughly. In addition, it is preferable that people not have to enter the containers to clean them. Thus, automatic cleaning apparatus is generally necessary for cleaning the inside of the containers.

Current automatic cleaning apparatus for cleaning these portable containers generally takes the form of a sprayhead for spraying a spray of cleaning solution into the container. The sprayhead may rotate about a container longitudinal axis and may translate into and out of the container to clean the container interior.

A particular problem area of the container is located at the center of the bottom of the container. Current cleaning apparatus tends to leave an uncleaned circular area in the bottom of the container.

A further problem area for containers with permanently installed agitators occurs on the interior side of the container in the location opposite the agitator from the sprayhead. Current cleaning apparatus tends to leave an uncleaned "blind spot" on the side of the container. This is because the sprayhead directs a solution stream radially outwardly from the sprayhead longitudinal axis, and as the sprayhead rotates within the container about the container longitudinal axis, the agitator blocks the path of the solution stream, thus preventing the solution stream from reaching the area on the side of the container opposite the agitator from the cleaning head.

It is therefore an objective of the present invention to provide an improved cleaning apparatus for cleaning containers.

It is another objective of the present invention to provide apparatus for cleaning portable containers which cleans completely to the center of the bottom of the container and does not leave an uncleaned spot thereat.

It is yet another objective of the present invention to provide apparatus for cleaning portable containers which has the ability to fully clean the side of the container opposite the permanent agitator from the sprayhead such that no uncleaned "blind spot" is left there.

SUMMARY OF THE INVENTION

The present invention attains the stated objectives by providing apparatus for cleaning a container having a top, an opening in the top, a bottom, sides and a longitudinal axis comprising a sprayhead for spraying cleaning solution inside the container and being translatably movable along the container longitudinal axis into the container and rotatably movable about the container longitudinal axis within the container. The sprayhead has a pair of spray nozzle orifices opposing one another and being aimed into the container in the general direction of movement of the sprayhead as the sprayhead translates into the container. The nozzle orifices are oriented such that the solution streams exiting the pair of nozzle orifices cross and clean the bottom substantially completely at its center without leaving an uncleaned circle on the bottom.

In a preferred form of the apparatus of the present invention, the nozzle orifices are disposed on opposite sides of the longitudinal axis of the sprayhead. Each of the pair of nozzle orifices has an axis oriented at about 45° from a lower end of the sprayhead relative to the sprayhead longitudinal axis. Each of the pair of nozzle orifices has a face generally perpendicular a respective nozzle orifice axis. The nozzle orifice axis intersects the nozzle face at a distance of about 0.750 inch from the sprayhead longitudinal axis for each of the nozzle orifices. The axes of the nozzle orifices are parallel and spaced at a distance of about 0.312 inch on either side of the sprayhead longitudinal axis.

According to another aspect of the present invention, the sprayhead preferably has a second pair of spray nozzle orifices aimed radially outwardly from a longitudinal axis of the sprayhead and spaced about the sprayhead longitudinal axis. One nozzle orifice of the second pair is aimed such that a solution stream exiting the orifice cleans underneath the container top. The other nozzle orifice of the second pair is aimed such that a solution stream exiting this orifice cleans the container sides.

Preferably the one nozzle orifice has an axis oriented at about 78° from a lower end of the sprayhead relative to the sprayhead longitudinal axis, and the other nozzle orifice has an axis oriented at about 78° from an upper end of the sprayhead relative to the sprayhead longitudinal axis, with the nozzle orifices being spaced about the sprayhead longitudinal axis by about 180°.

Means are provided for translating the sprayhead along the container longitudinal axis into the container and for rotating the sprayhead about the container longitudinal axis within the container. The translating and rotating means take the form of a tube to which is connected the sprayhead, a tube support rotatably supporting the tube on one end and the other end of the tube being slidably supported by a plate adapted to be mounted to the container. A ball screw has one end rotatably supported by the plate, and has the other end carrying a ball nut, which is connected to the tube support. A motor is provided for rotating the tube and hence sprayhead, and another motor is provided for rotating the ball screw to translate the tube and hence sprayhead.

The translating and rotating means further comprise a support frame, and a moving frame movably mounted on the support frame. The moving frame is connected to the plate. A piston and cylinder is connected between the support frame and the plate, actuation of which translates the moving frame. The tube support is movably mounted in the moving frame. Rollers on the support frame rollably support the moving frame, and rollers on the tube support rollably support the tube support in the moving frame.

According to still another aspect of the present invention, apparatus for cleaning a container having a top, an opening in the top, a bottom, sides and a longitudinal axis and a fixed agitator is provided. The apparatus comprises a sprayhead for spraying cleaning solution inside the container and being translatably movable along the container longitudinal axis into the container and rotatably movable about the container longitudinal axis within the container, the sprayhead having a pair of nozzle orifices oppositely directed and being aimed toward the sides of the container and defining an axis offset from and not intersecting a sprayhead longitudinal axis, whereby respective solution streams exiting the pair of nozzle orifices clean the side of the container behind the fixed agitator without leaving an uncleaned blind spot behind the agitator as the sprayhead rotates within the container. One of the pair of nozzle orifices is aimed slightly upwardly, and the other of the pair of nozzle orifices is aimed slightly downwardly, and in the preferred form, the one nozzle orifice has an axis oriented at about 78° from a lower end of the sprayhead relative to the sprayhead longitudinal axis while the other nozzle orifice has an axis oriented at about 78° from an upper end of the sprayhead relative to the sprayhead longitudinal axis, the nozzle orifices being oppositely directly by about 180°.

Methods of cleaning a container with and without an agitator are also provided.

One advantage of the present invention is that improved cleaning apparatus for cleaning containers is provided.

Another advantage of the present invention is that container cleaning apparatus is provided which cleans substantially completely to the center of the bottom of the container and does not leave an uncleaned spot.

Yet another advantage of the present invention is that container cleaning apparatus is provided which does not leave a blind spot on the side of the container, in containers having permanent agitators, opposite the agitator from the cleaning head.

These and other objects and advantages of the present invention will become more readily apparent during the following detailed description taken in conjunction with the drawings herein, in which:

DETAILED DESCRIPTION OF THE INVENTION

Figure 1:
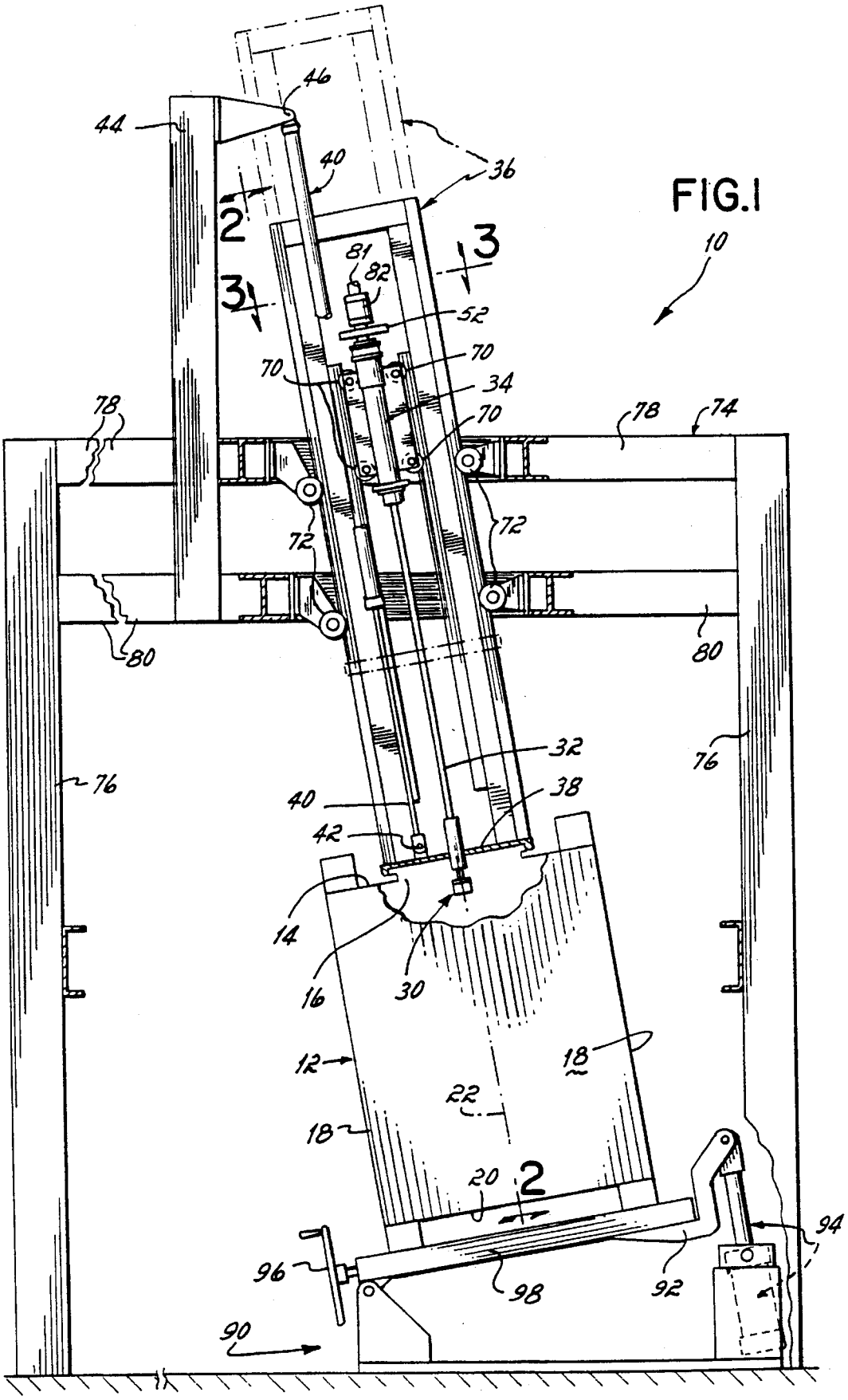
FIG. 1 is a side elevational view of the cleaning apparatus of the present invention.

Referring first to FIG. 1, there is illustrated apparatus 10 for cleaning a container 12 which has a top 14 with an opening 16 therein, sides 18 and a bottom 20. Container 12 also has a longitudinal axis 22.

Figure 2:
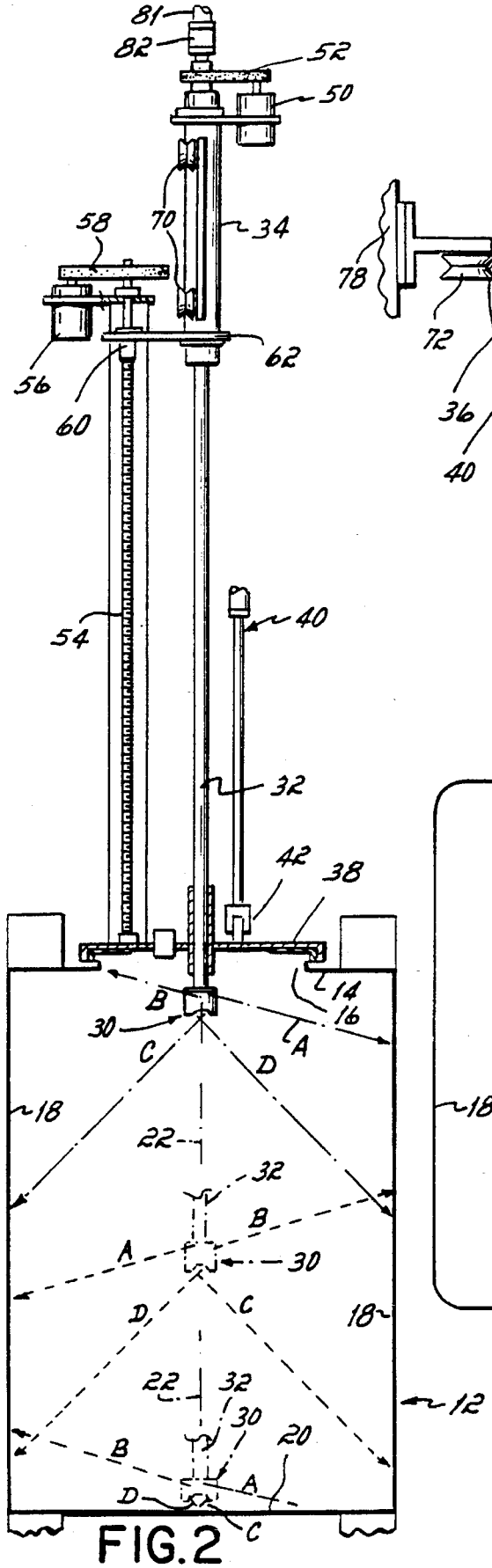
FIG. 2 is a view taken along line 2—2 of FIG. 1.
Figure 3:
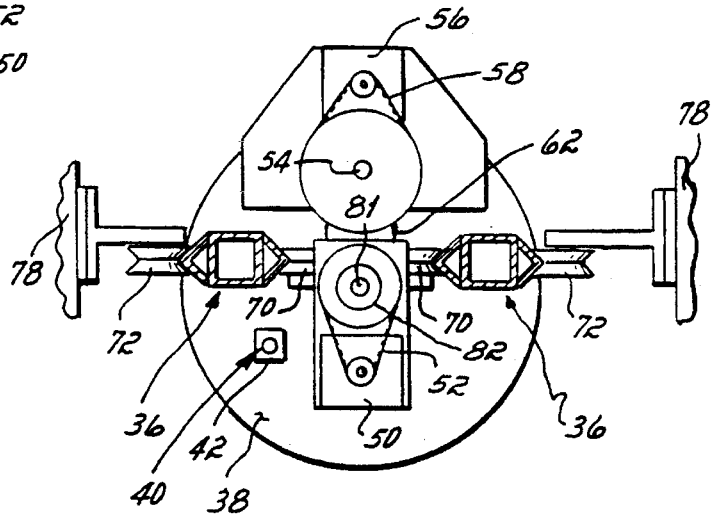
FIG. 3 is a view taken along line 3—3 of FIG. 1.

Referring now to FIGS. 1–3, the apparatus 10 includes a sprayhead 30 which will be described in more detail subsequently. The sprayhead 30 is mounted to a tube 32 which is supported for rotation within a tube support 34. Tube support 34 is mounted for longitudinal movement within a moving frame 36. The moving frame 36 includes a cover plate 38 at its lower end which is adapted to be secured to the container top opening 16. A piston and cylinder 40 is connected to the plate at 42 on one end and to a vertical support 44 of a support frame which will be subsequently described on another end 46. The piston and cylinder 40 provides for upward and downward movements of the moving frame 36 so as to engage the container 12 prior to subsequent cleaning.

A motor 50 is mounted on the upper end of the tube support 34 and drives a belt 52 which in turn drives the tube 32 in rotation which rotates the sprayhead 30. To translate the sprayhead 30 into and out of the container 12, a ball screw 54 is supported atop the plate 38 and is driven by a motor 56 by way of a drive belt 58. A ball nut 60 which threadably engages the ball screw 54 is connected to the tube support 34 at 62. Selective actuation of the ball screw 54 by the motor 56 causes the sprayhead 30 to translate down into and back out of the tote container 12.

Rollers 70 support the tube support 34 for rolling movement within the moving frame 36. Rollers 72 support the moving frame 36 externally of frame 36 for rolling movement within a support frame 74. Support frame 74 includes vertical support members 76, 76 and a pair of horizontal support members 78, 80 connected to the upper ends of the vertical support members 76, 76. Rollers 72 are rotatably supported from the members 78, 80, and support 44 to which piston and cylinder 40 is connected to and extends upwardly from the pair of supports 78, 80 near one end thereof. Liquid solution from a liquid solution supply supplies the upper end 81 of the tube 32 and hence the sprayhead 30. A preferable cleaning solution is a high flashpoint, biodegradable solvent such as NMP (n-methyl pyrrolidone), or a mixture of similar solvents. Supply tubes 32 and 81 are coupled through a rotary coupling 82.

As is seen in FIG. 1, container 12 is supported atop a container base 90 which includes a raisable and lowerable portion 92 raisable and lowerable by a piston and cylinder 94. The raisable and lowerable portion 92 is raised so as to position the container 12 at an angle preferably about 10° so that the solution will drain to a lowermost corner or edge of the container 12 to aid in vacuuming the solution out of the container. A rotatable hand wheel 96 actuates a centering mechanism (not shown) to locate container 12 in two directions atop a platform 98 of the base assembly 90 so that cover plate 38 properly engages opening 160 of container 12 when moving frame 36 is moved downwardly. Other devices such as air gear motors, electric motors or other means can be used to locate container 12 atop platform 98.

Figure 4:
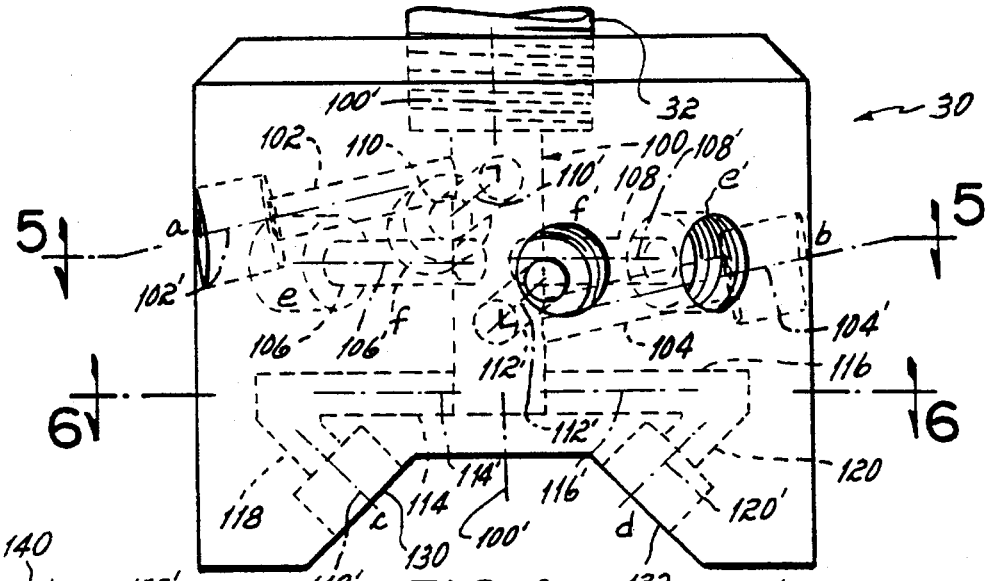
FIG. 4 is a side elevational view of the sprayhead of the cleaning apparatus of the present invention.
Figure 5:
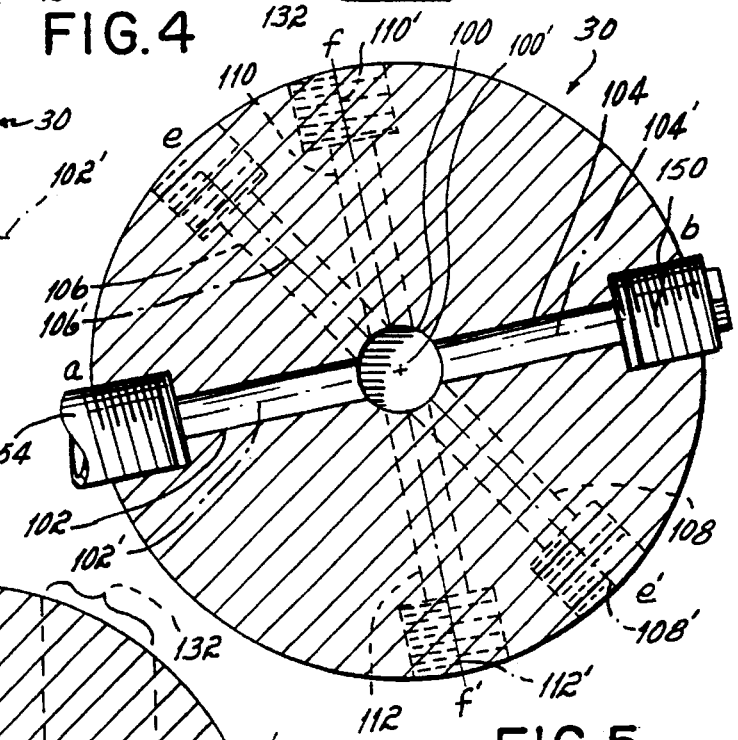
FIG. 5 is a view taken along line 5—5 of FIG. 4.
Figure 6:
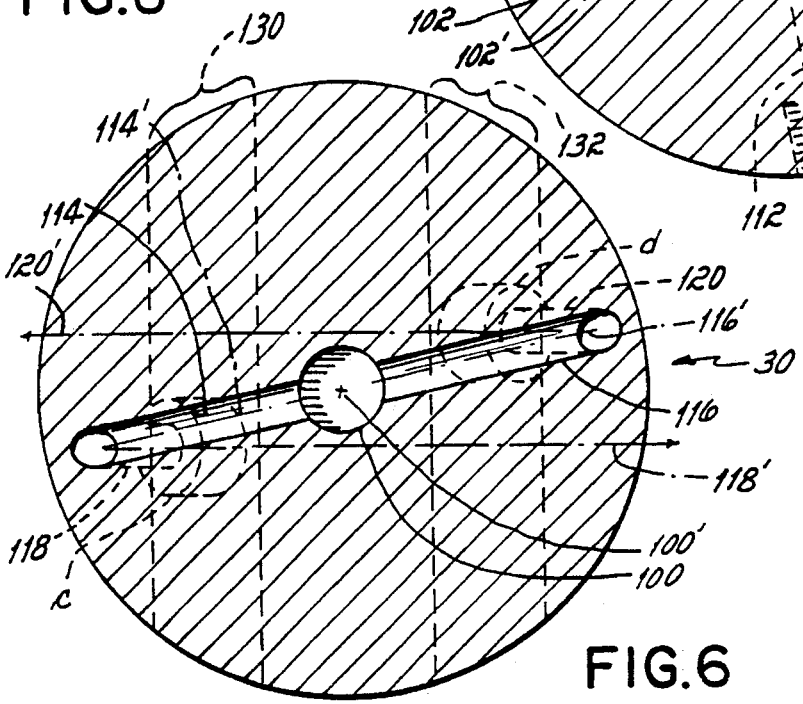
FIG. 6 is a view taken along line 6—6 of FIG. 4.

Referring now to FIGS. 2 and 4–6, the cleaning head 30 will now be described in more detail. The cleaning sprayhead 30, which is approximately 3.5 inches in diameter and 3 inches tall, includes multiple ports or orifices for accepting nozzles, and a number of different nozzle configurations are possible based on the multiple ports. Specifically, the cleaning head 30 includes ports a, b, c, d, e, ', f and f'. A central longitudinal supply passage 100 corresponding to a longitudinal sprayhead axis 100' supplies radial passages 102, 104, 106, 108, 110, and 112, which in turn supply ports a, b, e, e', f and f', respectively Passages 106 and 108 which supply ports e and e' respectively are oriented perpendicularly with respect to the central longitudinal supply passage 100 and have axes 106' and 108' respectively. Passages 102 and 110 are oriented approximately 78° from a lower end of the sprayhead 30 relative to the central longitudinal supply passage 100 and have axes 102' and 110' respectively, and passages 104 and 112 are oriented approximately 78° from an upper end of the sprayhead 30 relative to the central longitudinal passage 100 and have axes 104' and 112' respectively. Additional passages 114 and 116 connect with the lower end of the central longitudinal passage 100 and supply ports c and d, respectively. Passage 114 includes an elbow 118 having an axis 118' which is oriented approximately 45° from the lower end of the sprayhead 30 relative to the longitudinal passage 100. Similarly, passage 116 includes an elbow 120 having an axis 120' likewise oriented approximately 45° from the lower end of the sprayhead 30 relative to the longitudinal passage 100. The axes 118° and 120° of portions 118 and 120 thus cross but do not intersect. Each of the ports c and d has a face 130, 132 respectively which is oriented at approximately right angles to the axes 118° and 120° of the ports c and d respectively. Each nozzle orifice axis 118° and 120° intersects a respective nozzle face 130, 132 at a distance of about 0.750 inches from the sprayhead longitudinal axis 100°. In addition, the axes 118° and 120° of the nozzle orifices c and d are parallel and spaced at a distance of about 0.312 inches on either side of the sprayhead longitudinal axis 100', as is shown in FIG. 6.

As is seen in FIGS. 4, 5 and 6, the axes 110', 112' defined by passages 110', 112' are oriented at approximately 90° to the axes 102', 104' formed by the passages 102, 104, which is oriented at approximately 0° relative to the axes 114', 116' defined by the passages 114 and 116. The axes 106' 108' defined by the passages 106, 108 is oriented at approximately 12° counterclockwise from the axes 110', 112' defined by the passages 110, 112 as viewed in FIG. 5, though passages 106, 108 could be positioned at 45° midway between passages 110, 112 and 102, 104.

Figure 8:
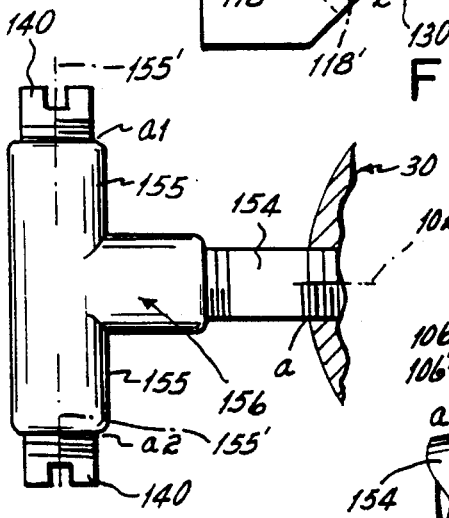
FIG. 8 is an enlarged view of the pipe tee nozzle assembly creating the solution streams of FIG. 7.

All of the ports a, b, c, d, e, e', f and f' are 0.25 inch NPT female pipe thread which receive a standard nozzle, such as that shown in FIG. 8 at 140.

Referring now back to FIG. 2, it will be seen that nozzle orifices a, b, c and d define solution streams A, B, C and D. Solution stream A is operable to clean the sides 18 of the container 12 as the sprayhead 30 rotates about the container longitudinal axis 22 and translates down into the container. Likewise, solution stream B is operable to clean underneath the top 14 of the container 12 as well as to clean the sides 18. Crossing non-intersecting solution streams C and D clean the sides 18 of the container 12 as the sprayhead 30 translates down into the container, and as the sprayhead 30 approaches the bottom 20 of the container, the solution streams C and D impinge upon the bottom 12 and gradually move inwardly towards the center of the container 20 as the head 30 gets closer and closer to the bottom 20. Ultimately, when the head 30 is close enough to the bottom 20 of the container 12, the solution streams C and D, which diverge as they exit nozzle orifices c and d, actually cross but do not intersect, thereby substantially completely cleaning the container bottom 20 to the center and thereby avoiding leaving an uncleaned circular area in the bottom of the container as do many prior art cleaning devices.

In the spray configuration of FIG. 2, ports a, b, c and d are utilized. In that case, ports e, , e' f and f' are plugged with a threaded plug, such as that shown at 150 in FIG. 5.

Figure 7:
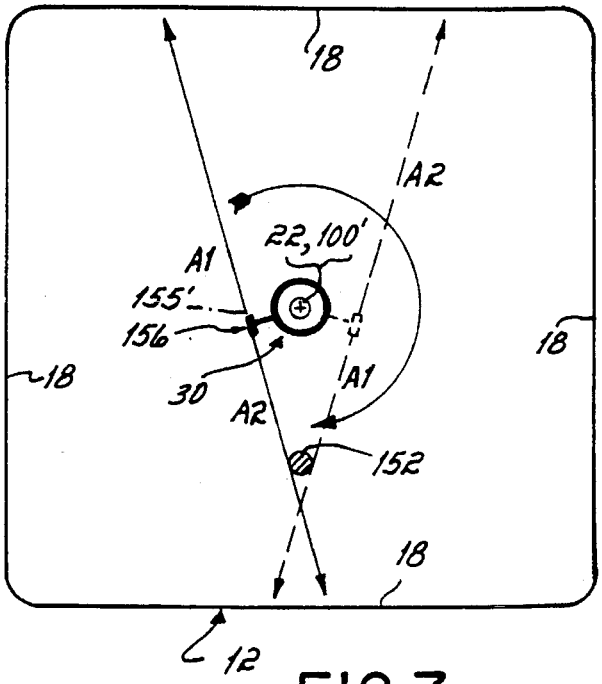
FIG. 7 is a view illustrating the reach of the solution streams in avoiding the blind spot on the side of the container opposite the permanent agitator from the sprayhead.

Other sprayhead configurations are possible. Referring now to FIGS. 5, 7 and 8, a sprayhead configuration which is specifically designed to clean behind a fixed agitator, such as that shown at 152 in FIG. 7, will be described. In FIG. 5, the orifice a is outfitted with a nipple 154. Then a standard pipe tee 156 is threaded onto the nipple 154. The opposing passages 155, 155 of the pipe tee 156 include nozzle orifices a1 and a2 each of which is outfitted with a nozzle 140. The passages 155 thus define an axis 155' which is offset from the longitudinal axis 100' of the sprayhead 30 by, preferably, at least about 5 to 6 inches. As seen in FIG. 7, solution streams A1 and A2 exiting the nozzles 140 of the tee 156 are opposed to one another at 180°. As the sprayhead 30 rotates, the first solution stream A1 angles behind the agitator 152 to clean the side 18 of the container 12 behind the agitator 152 which extends substantially the entire depth of the container 12, and as the sprayhead 30 continues to rotate, the opposite solution stream A2 similarly cleans behind the agitator 152 from the opposite direction, thus producing a crossing pattern and completely cleaning the side 18 of the container 12 which is located behind the agitator 152. This location or area remains an uncleaned blind spot when utilizing many prior art cleaning devices. Preferably the pipe tee 156 is oriented such that the axis 155' of one of the nozzle orifices a1 is oriented at 78° upwardly from the bottom of the sprayhead 30 and the axis 155° of the other of the nozzle orifices a2 is oriented downwardly from the upper end of the sprayhead 30 at approximately 78°. It will be appreciated that the nozzle configuration which results in the solution stream pattern of FIG. 7 could likewise be employed with the orifices required to produce the nozzle stream pattern of FIG. 2, in which case six total solution streams would be utilized.

In use, the container 12 is located atop the base 90 and secured with wheel 96. Piston and cylinder 40 is actuated to move the moving frame 36 downwardly until the cover plate 38 engages the top opening 16 of the container 12. Next, motor 50 is actuated to rotate tube 32 and hence sprayhead 30, and motor 56 is actuated to move the support tube 34 downwardly relative to the moving frame 36 and hence the sprayhead 30 downwardly into the container 12. Assuming the nozzle configuration chosen was that as shown in FIG. 2, the sprayhead 30 is continuously rotated and moved downwardly into the container. Sprayhead 30 is preferably moved from the top of the container to the bottom and back to the top again in approximately 4–12 minutes. Solution stream A cleans the sides of the container, solution stream B cleans underneath the top and the sides of the container, and solution streams C and D clean the sides of the container. When the sprayhead 30 is located close enough to the bottom of the container, solution streams C and D gradually work their way peripherally inwardly cleaning the bottom of the container until the streams actually cross thereby cleaning completely to the center of the container. The pressure of the solution streams is preferably 5,000–10,000 psi. Solvent which collects in the container 12 is continuously vacuumed out so that the sprayhead is not working immersed in solvent solution which would dissipate the force of the solution streams. Once cleaning is completed, motor 50 is disengaged thereby ceasing rotation of tube 32 and sprayhead 30, and motor 56 is engaged in the opposite direction to drive tube support 34 and enhance tube 32 and sprayhead 30 upwardly. Once located at the uppermost position, plate 38 of moving frame 36 is disengaged from the container 12 via the piston and cylinder 40. Solution collected in the bottom of the container 12 may then be vacuumed out and the container removed from the base 90.

Use of the apparatus 10 employing different nozzle configurations proceeds in much the same manner, with the specific nozzle configuration being selected prior to the cleaning operation.

Those skilled in the art will readily recognize numerous adaptations and modifications which can be made of the present invention which will result in an improved container cleaning apparatus and method, yet all of which will fall within the spirit and scope of the present invention as defined in the following claims. For example, angles other than those disclosed can be utilized in the practice of the present invention. The upwardly directed nozzle orifices which clean the container sides and underneath the top could be angled upwardly by an additional 10° to 22° or even by an additional 45° to 57° for greater upward direction of the solution streams. Further, while the radially directed nozzles have been disclosed as threaded directly into the sprayhead, nipple extensions on the order of 6 inches long could be threaded into the spray head, with the nozzles then being threaded onto the ends of the nipple extensions via couplings. Further, while the threaded holes in the sprayhead could be initially drilled at the 22° or 57° orientations as well as the described 12° orientation, the nipple extensions could be bent upwardly at their ends by either 10° or 45° to produce the 22° or 57° solution stream orientations respectively. Accordingly, the invention is to be limited only by the scope of the following claims and their equivalents.

What is claimed is:

1. Apparatus for cleaning a container having a top, an opening in the top and having a bottom, sides, and a longitudinal axis comprising:

a sprayhead for spraying cleaning solution inside the container and being translatably moveable along the container longitudinal axis into the container and rotatably moveable by a motor about the container longitudinal axis within the container;

said sprayhead having a pair of spray nozzle orifices generally opposing one another and being aimed into the container in the general direction of movement of said sprayhead as said sprayhead translates into the container, the respective axes of said nozzle orifices first converging then diverging without intersecting beneath said sprayhead;

said nozzle orifices being oriented such that the solution streams exiting said pair of nozzle orifices impact the sides of the container to clean the sides, and as said sprayhead translates along the container longitudinal axis, progressively impact the bottom to clean the bottom and cross and clean the bottom substantially completely at its center without leaving an uncleaned circle on the bottom.

2. The apparatus of claim 1 wherein said nozzle orifices are disposed on opposite sides of a longitudinal axis of said sprayhead.

3. The apparatus of claim 2 wherein each of said pair of nozzle orifices has an axis oriented at about 45° from a lower end of said sprayhead longitudinal axis.

4. The apparatus of claim 3 wherein each of said pair of nozzle orifices has a face generally perpendicular to a respective nozzle orifice axis.

5. The apparatus of claim 4 wherein said nozzle orifice axis intersects said nozzle face at a distance of about 0.750 inches from said sprayhead longitudinal axis for each of said nozzle orifices.

6. The apparatus of claim 5 wherein said axes of said nozzle orifices are parallel and spaced at a distance of about 0.312 inches on either side of said sprayhead longitudinal axis.

7. The apparatus of claim 1 wherein:

said sprayhead has a second pair of spray nozzle orifices aimed radially outwardly from a longitudinal axis of said sprayhead and spaced about said sprayhead longitudinal axis;

one nozzle orifice of said pair being aimed whereby a solution stream exiting therefrom cleans underneath the container top;

the other nozzle orifice of said pair being aimed whereby a solution stream exiting therefrom cleans the container sides.

8. The apparatus of claim 7 wherein:

said one nozzle orifice has an axis oriented at about 78° from a lower end of said sprayhead relative to said sprayhead longitudinal axis;

said other nozzle orifice has an axis oriented at about 78° from an upper end of said sprayhead relative to said sprayhead longitudinal axis;

said nozzle orifices being spaced about said sprayhead longitudinal axis by about 180°.

9. Apparatus for cleaning a container having a top, an opening in the top, and having a bottom, sides, and a longitudinal axis comprising:

a sprayhead for spraying cleaning solution inside the container;

means for translating said sprayhead along the container longitudinal axis into the container;

a motor for rotating said sprayhead about the container longitudinal axis within the container;

said sprayhead having a pair of generally opposed spray nozzle orifices on a lower end of said sprayhead on opposite sides of a longitudinal axis of said sprayhead and being aimed toward the bottom of the container, the respective axes of said nozzle orifices first converging then diverging without intersecting beneath said sprayhead;

said nozzle orifices being oriented such that the solution streams exiting said pair of nozzle orifices impact the sides of the container to clean the sides and, as said sprayhead translates along the container longitudinal axis, progressively impact the bottom to clean the bottom and cross and clean the bottom substantially completely at its center without leaving an uncleaned circle on the bottom.

10. The apparatus of claim 9 wherein:

said sprayhead has a second pair of spray nozzle orifices aimed radially outwardly from a longitudinal axis of said sprayhead and spaced about said sprayhead longitudinal axis;

one nozzle orifice of said pair being aimed whereby a solution stream exiting therefrom cleans underneath the container top;

the other nozzle orifice of said pair being aimed whereby a solution stream exiting therefrom cleans container sides.

11. The apparatus of claim 9 wherein said means for translating and rotating said sprayhead comprise:

a tube, said sprayhead being connected to said tube;

a tube support rotatably supporting said tube on one end;

a plate adapted to be mounted to the container, the other end of said tube being slidably supported by said plate;

a ball screw having one end rotatably supporting by said plate, the other end of said ball screw carrying a ball nut, said ball nut being connected to said tube support;

a motor for rotating said tube; and a motor for rotating said ball screw.

12. The apparatus of claim 11 further including:

a support frame;

a moving frame movably mounted on said support frame, said moving frame being connected to said plate;

a piston and cylinder connected between said support frame and said plate;

said tube support being movably mounted in said moving frame.

13. The apparatus of claim 12 further including:

rollers on said support frame rollably supporting said moving frame; and rollers on said tube support rollably supporting said tube support in said moving frame.

14. Apparatus for cleaning a container having a top, an opening in the top, and having a bottom, sides and a longitudinal axis and a fixed agitator comprising:

a sprayhead for spraying cleaning solution inside the container and being translatably moveable along the container longitudinal axis into the container and rotatably moveable about the container longitudinal axis within the container;

said sprayhead having a pair of nozzle orifices oppositely directed and being aimed toward the sides of the container and defining an axis offset from and not intersecting a sprayhead longitudinal axis, one of said pair of nozzle orifices being a leading orifice and the other one of said pair being a trailing orifice, each of said orifices producing a solution stream;

said nozzle orifices being oriented such that the solution streams exiting said pair of nozzle orifices clean the side of the container behind the fixed agitator without leaving an uncleaned blind spot behind the agitator as said sprayhead rotates within the container, the solution stream of said leading orifice cleaning the container side to one surface extent, the solution stream of said trailing orifice cleaning the container side to another surface extent such that the entire surface extent of the container side behind the agitator is cleaned.

15. The apparatus of claim 14 wherein:

one of said pair of nozzle orifices is aimed upwardly;

the other of said pair of nozzle orifices is aimed downwardly.

16. The apparatus of claim 14 wherein:

said one nozzle orifice has an axis oriented at about 78° from a lower end of said sprayhead relative to said sprayhead longitudinal axis;

said other nozzle orifice has an axis oriented at about 78° from an upper end of said sprayhead relative to said sprayhead longitudinal axis;

said nozzle orifices being oppositely directed by about 180°.

17. The apparatus of claim 14 wherein:

said sprayhead has a second pair of spray nozzle orifices opposing one another and being aimed into the container in the general direction of movement of said sprayhead as said sprayhead translates into the container;

said nozzle orifices being oriented such that the solution streams from said second pair of nozzles impact the sides of the container to clean the sides and, as said sprayhead translates along the container longitudinal axis, progressively impact the bottom to clean the bottom and cross and clean the bottom substantially completely at its center without leaving an uncleaned circle on the bottom.

18. The apparatus of claim 14 wherein:

said sprayhead has a second pair of spray nozzle orifices aimed radially outwardly from said sprayhead longitudinal axis and spaced about said sprayhead longitudinal axis;

one nozzle orifice of said second pair being aimed upwardly whereby a solution stream exiting therefrom cleans underneath the container top;

the other nozzle orifice of said pair being aimed downwardly whereby a solution stream exiting therefrom cleans the container side.

19. Apparatus for cleaning a container having a top, an opening in the top, and having a bottom, sides, and a longitudinal axis comprising:

a sprayhead for spraying cleaning solution inside the container;

means for translating said sprayhead along the container longitudinal axis into the container;

means for rotating said sprayhead about the container longitudinal axis within the container;

said sprayhead having a pair of nozzle orifices oppositely directed and being aimed toward the sides of the container and defining an axis offset from and not intersecting a sprayhead longitudinal axis, one of said pair of nozzle orifices being a leading orifice and the other one of said pair being a trailing orifice, each of said orifices producing a solution stream;

said nozzle orifices being oriented such that the solution streams exiting said pair of nozzle orifices clean the side of the container behind the fixed agitator without leaving an uncleaned blind spot behind the agitator as said sprayhead rotates within the container, the solution stream of said leading orifice cleaning the container side to one surface extent, the solution stream of said trailing orifice cleaning the container side to another surface extent, such that the entire surface extent of the container side behind the agitator is cleaned.

20. The apparatus of claim 19 wherein:

said sprayhead has a second pair of spray nozzle orifices opposing one another and being aimed into the container in the general direction of movement of said sprayhead as said sprayhead translates into the container;

said nozzle orifices being oriented such that the solution streams exiting said pair of nozzle orifices impact the sides of the container to clean the sides and, as said sprayhead translates along the container longitudinal axis, progressively impact the bottom to clean the bottom and cross and clean the bottom substantially completely at its center without leaving an uncleaned circle on the bottom.

21. The apparatus of claim 20 wherein the said means for translating and rotating said sprayhead comprises:

a tube, said sprayhead being connected to said tube;

a tube support rotatably supporting said tube on one end;

a plate adapted to be mounted to the container, the other end of said tube being slidably supported by said plate;

a ball screw having one end rotatably supporting by said plate, the other end of said ball screw carrying a ball nut, said ball nut being connected to said tube support;

a motor for rotating said tube; and a motor for rotating said ball screw.

22. The apparatus of claim 21 further including:

a support frame;

a moving frame movably mounted on said support frame, said moving frame being connected to said plate;

a piston and cylinder connected between said support frame and said plate;

said tube support being movably mounted in said moving frame.

23. The apparatus of claim 22 further including:

rollers on said support frame rollably supporting said moving frame; and rollers on said tube support rollably supporting said tube support in said moving frame.

24. A method for cleaning a container having a top, an opening in the top, and having a bottom, sides and a longitudinal axis comprising:

providing a sprayhead for spraying cleaning solution inside the container and being translatably moveable by a motor along the container longitudinal axis into the container and rotatably moveable by a motor about the container longitudinal axis within the container;

said sprayhead having a pair of spray nozzle orifices generally opposing one another and being aimed into the container in the general direction of movement of said sprayhead as said sprayhead translates into the container, the respective axes of said nozzle orifices first converging then diverging without intersecting beneath said sprayhead;

rotating said sprayhead while translating said sprayhead into the container;

said nozzle orifices being oriented such that the solution streams exiting said pair of nozzle orifices impact the sides of the container to clean the sides and, as said sprayhead translates along the container longitudinal axis, progressively impact the bottom to clean the bottom and cross and clean the bottom substantially completely at its center without leaving an uncleaned circle on the bottom.

25. A method of cleaning a container having a top, an opening in the top, and having a bottom, sides and a longitudinal axis and a fixed agitator comprising:

providing a sprayhead for spraying cleaning solution inside the container and being translatably moveable along the container longitudinal axis into the container and rotatably moveable about the container longitudinal axis within the container;

said sprayhead having a pair of nozzle orifices oppositely directed and being aimed toward the sides of the container and defining an axis offset from and not intersecting a sprayhead longitudinal axis, one of said pair of nozzle orifices being a leading orifice and the other one of said pair being a trailing orifice, each of said orifices producing a solution stream;

rotating said sprayhead in the container;

said nozzle orifices being oriented such that the solution streams exiting said pair of nozzle orifices clean the sides of the container behind the fixed agitator without leaving an uncleaned blind spot behind the agitator as said sprayhead rotates within the container, the solution stream of said leading orifice cleaning the container side to one surface extent, the solution stream of the trailing orifice cleaning the container side to another surface extent, such that the entire surface extent of the container side behind the agitator is cleaned.

26. Apparatus for cleaning a container having a top, an opening in the top, and having a bottom, sides and a longitudinal axis and a fixed agitator comprising:

a sprayhead for spraying cleaning solution inside the container and being translatably movable along the container longitudinal axis into the container and rotatably movable about the container longitudinal axis within the container;

said sprayhead having a pair of nozzle orifices aimed toward the sides of the container, at least one of said nozzle orifices defining an axis which is offset from and does not intersect a sprayhead longitudinal axis, one of said pair of nozzle orifices being a leading orifice and the other one of said pair being a trailing orifice, each of said orifices producing a solution stream;

said nozzle orifices being oriented so as to cooperate to define a crossing pattern of solution streams relative to the agitator such that the solution stream exiting said nozzle orifices clean the side of the container behind the fixed agitator without leaving an uncleaned blind spot behind the agitator as said sprayhead rotates within the container, the solution stream of said leading orifice cleaning the container side to one surface extent, the solution stream of said trailing orifice cleaning the container side to another surface extent, such that the entire surface extent of the container side behind the agitator is cleaned.

27. Apparatus for cleaning a container having a top, an opening in the top and having a bottom, sides, and a longitudinal axis and a fixed agitator comprising:

a sprayhead for spraying cleaning solution inside the container and being translatably moveable along the container longitudinal axis into the container and rotatably moveable by a motor about the container longitudinal axis within the container;

said sprayhead having a first pair of spray nozzle orifices generally opposing one another and being aimed into the container in the general direction of movement of said sprayhead as said sprayhead translates into the container, the respective axes of said nozzle orifices first converging then diverging without intersecting beneath the sprayhead;

said first pair of nozzle orifices being oriented such that the solution streams exiting said pair of nozzle orifices impact the sides of the container to clean the sides and, as said sprayhead translates along the container longitudinal axis, progressively impact the bottom to clean the bottom and cross and clean the bottom substantially completely as its center without leaving an uncleaned circle on the bottom;

said sprayhead having a second pair of nozzle orifices oppositely directed and being aimed toward the sides of the container and defining an axis offset from and not intersecting a sprayhead longitudinal axis, one of said pair of nozzle orifices being a leading orifice and the other one of said pair being a trailing orifice, each of said orifices producing a solution stream;

said second pair of nozzle orifices being oriented such that the solution streams exiting said pair of nozzle orifices clean the side of the container behind the fixed agitator without leaving an uncleaned blind spot behind the agitator as said sprayhead rotates within the container, the solution stream of said leading orifice cleaning the container side to one surface extent, the solution stream of said trailing orifice cleaning the container side to another surface extent, such that the entire surface extent of the container side behind the agitator is cleaned.

* * * * *